US010118747B2

(12) United States Patent
Polt

(10) Patent No.: US 10,118,747 B2
(45) Date of Patent: Nov. 6, 2018

(54) LID WITH SANITARY PROVISIONS

(71) Applicant: B. Robert Polt, Redmond, WA (US)

(72) Inventor: B. Robert Polt, Redmond, WA (US)

(73) Assignee: RUUMI CUP, Redmond, WA (US)

( * ) Notice: Subject to any disclaimer, the term of this patent is extended or adjusted under 35 U.S.C. 154(b) by 448 days.

(21) Appl. No.: 14/550,988

(22) Filed: Nov. 22, 2014

(65) Prior Publication Data

US 2016/0145010 A1 May 26, 2016

(51) Int. Cl.

| | |
|---|---|
| ***A47G 19/22*** | (2006.01) |
| ***B65D 51/24*** | (2006.01) |
| ***B65D 43/02*** | (2006.01) |

(52) U.S. Cl.

CPC ..... *B65D 51/24* (2013.01); *B65D 43/0218* (2013.01); *B65D 2543/00046* (2013.01); *B65D 2543/00092* (2013.01); *B65D 2543/00296* (2013.01); *B65D 2543/00518* (2013.01); *B65D 2543/00537* (2013.01); *B65D 2543/00555* (2013.01)

(58) Field of Classification Search

CPC ..... B65D 2203/12; B65D 43/0212

See application file for complete search history.

(56) References Cited

U.S. PATENT DOCUMENTS

| | | | | |
|---|---|---|---|---|
| 7,819,271 | B2 * | 10/2010 | Hollis | B65D 43/0212 220/254.3 |
| 2006/0163251 | A1 * | 7/2006 | Kelstrom | B65D 43/0208 220/253 |

* cited by examiner

*Primary Examiner* — Jeffrey Allen

(74) *Attorney, Agent, or Firm* — McCarter & English, LLP

(57) ABSTRACT

A lid that, in order to keep the sip hole area sanitary when the lid is removed from the cup and is placed top-side down on a potentially contaminated surface, has raised locations on the top surface that lift the sip hole area at a distance from the potentially contaminated surface when the lid is placed on a surface.

4 Claims, 2 Drawing Sheets

LID WITH SANITARY PROVISIONS

CROSS-REFERENCE TO RELATED APPLICATION

This application claims the benefit of the filing date of U.S. Provisional Application No. 61/963,090, filed Nov. 23, 2013, entitled "SIP HOLE STOPPER AND LIFTS THAT PREVENT LID CONTAMINATION" under 37 U.S.C. § 119(e). Additionally, Application No. 61/963,090 is incorporated herein in its entirety for all purposes.

FIELD OF THE INVENTION

The field of invention relates generally to beverage containers and, more specifically but not exclusively relates to lids for beverage cups, mugs and the like.

BACKGROUND INFORMATION

Many times when people fill their travel cups, they need to remove the lid and set it aside, whether to reach for their wallet or to add cream or sugar to their drink. In some cases, such as in lids with nose accommodations (U.S. patent application Ser. No. 13/874,471) that have a central depression extending below the lower rim of the lid, setting the lid top-side down means that the underside of the lid, which comes in contact with the beverage when the lid is on, may touch a contaminated surface. Some regular lids have an interior rim that comes in contact with the beverage and can contact a contaminated surface when set bottom-side down. Also, a lid removed after being used can have liquid accumulated on the underside from condensation or from the beverage sloshing. That liquid can then drip onto the surface upon which the lid is sitting. Setting a regular lid top-side down, however, means that the sip hole area, whether the sip-hole is formed as a top surface hole or is the top rim when the hole is in the well below the top rim, can come in contact with the contaminated surface. All these situations are undesirable.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein like reference numerals refer to like parts throughout the various views unless otherwise specified.

DETAILED DESCRIPTION

Embodiments of a beverage container lid that enables users to set the lid top-side down without the area that comes in contact with the mouth during drinking touching the surface are described herein. In the following description, specific details are set forth to provide a thorough understanding of embodiments of the invention. One skilled in the relevant art will recognize, however, that the invention can be practiced without one or more of the specific details, or with other methods, components, etc. In other instances, well-known structures, materials, or operations are not shown or described in detail to avoid obscuring aspects of the invention.

As used herein in the detailed description and the claims, directional references such as front, rear, upward, downward, etc. may be made with reference to a lid assembly being upright and parallel to a horizontal surface or plane that is perpendicular to gravity.

For this invention, a raiser is understood as an elevation of the top surface of the lid. In a general sense, such a raiser can be a point, line, or surface that contacts a flat surface on which the lid is placed top-side down. The plane formed by the flat surface on which the lid sits is called the sitting plane. The plane formed by the raisers' contact points and another contact point, usually at the rear of the lid, is called the lifting plane. The lifting plane and the sitting plane coincide when the lid is set down on a flat surface.

Figure 1:
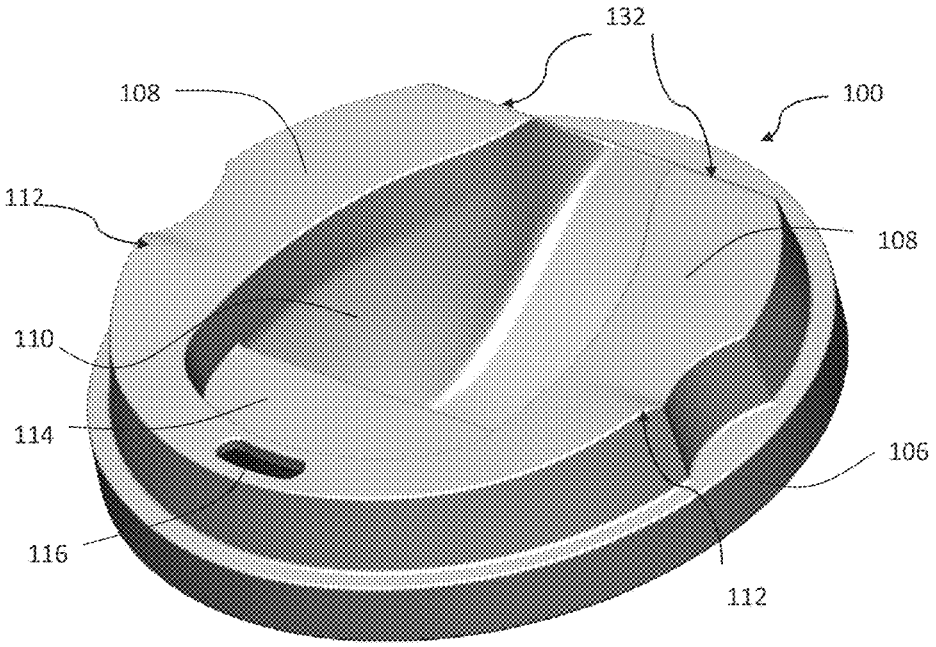
FIG. 1 is a topside isometric view of a lid including raised areas on the top, according to one embodiment.
Figure 2:
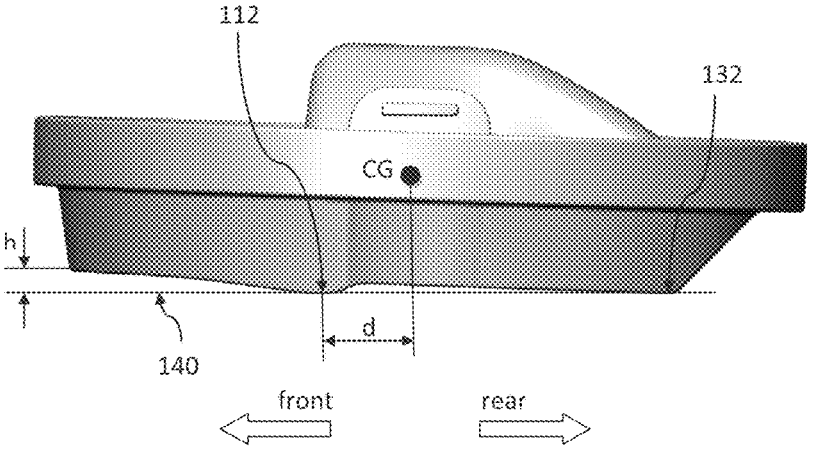
FIG. 2 is a side view of a lid set on a horizontal surface including raised areas, according to one embodiment.
Figure 3:
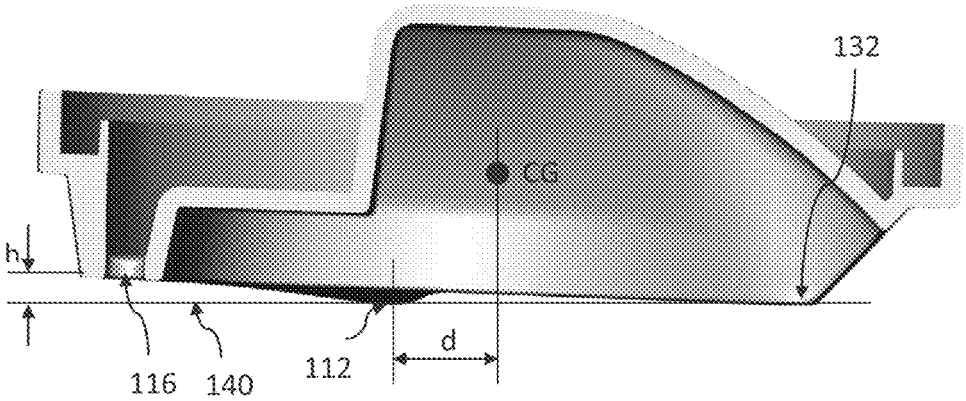
FIG. 3 is a cross-section of a lid illustrating the elevated position of the sip hole.

Various views of a lid 100 according to a first embodiment are shown in FIGS. 1, 2, and 3. FIG. 1 shows a topside isometric of lid 100 that includes a skirt 106 extending downward from a generally raised and plateaued area 108 formed around the periphery of the lid in which a well 110 is formed. In this embodiment the well includes a cavity formed in a rearward portion of the well that accommodates a human nose and a frontward shelf 114. Lid 100 also includes an orifice 116 formed in the front portion of the raised area 108 through which the beverage is consumed.

Front raisers 112 are provided at a distance d from center of gravity CG of the lid towards the sip hole 116 located at the front end of the lid. The peaks of these raisers together with the rear edge 132 form the lid-lifting plane 140. The raisers are preferably positioned at the periphery of the lid so as not to interfere with the face while drinking. This is especially true for the lid with nose cavity shown in FIG. 1, where a person's cheeks may come in contact with the plateaued areas 108.

Because the front raisers 112 are placed between the center of gravity CG of the lid and the sip hole 116, the lid's natural equilibrium position is such that it leans toward the rear end instead of toward the sip hole 116 in the front. Because the raisers are at a higher elevation than the rear edge, the natural position of the sitting lid is such that the sip hole, which is generally at a lower elevation than the raisers, will be lifted to an elevation h from the sitting plane 140. This is similar to a seesaw with the pivot point at the front raisers 112.

FIG. 3 shows a cross section of the same lid in which the sip hole 116 and its position above the surface, on which the lid sits, is clearly depicted.

Figure 4:
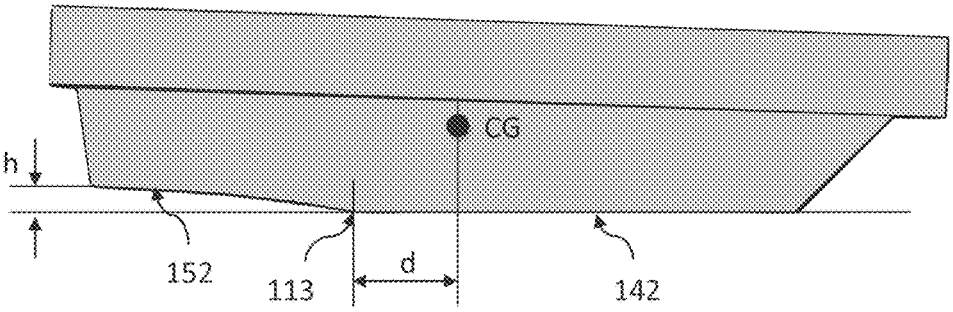
FIG. 4 is a side view of a lid illustrating an integrated raised surface.

Somebody skilled in the art will recognize that there are many geometrical configurations in which the raising of the sip hole from the sitting surface can be effected that are based on the same seesaw principle described above. For example, in another embodiment, shown in FIG. 4, instead of having the distinct protuberances 112 at the top of the lid, the same effect could be achieved with a integrated planar surface 142 that is continued by an upward-sloped front surface 152 starting at kink point 113 which serves as the pivot point of the seesaw structure.

The above description of illustrated embodiments of the invention is not intended to be exhaustive or to limit the invention to the precise forms disclosed. While specific embodiments of, and examples for, the invention are described herein for illustrative purposes, various equivalent modifications are possible within the scope of the invention, as those skilled in the relevant art will recognize.

The invention claimed is:

1. A lid, comprising:

a circular body configured to engage a top of a beverage container;

an orifice defined in a front portion of a top surface of the circular body; and two raised locations on the top surface of the circular body between the orifice and a center of gravity of the lid, the two raised locations being the highest locations on the lid so that the lid tilts on the two raised locations to lift the front portion when the top surface of the lid is placed on a horizontal surface.

2. The lid according to claim 1, wherein two raised locations are on opposite sides of the top surface.

3. The lid according to claim 2, wherein the two raised locations are protuberances of the top surface.

4. The lid according to claim 1, wherein the two raised locations are integral portions of the top surface.

* * * * *